US006851423B2

(12) United States Patent
Klemming

(10) Patent No.: US 6,851,423 B2
(45) Date of Patent: Feb. 8, 2005

(54) FIREPIT

(76) Inventor: Ulf J P Klemming, 215 Chao Hui Rd., Zhongshan Hua Yuan Qiu Yue Yuan 17A, Hangzhou, 310014 (CN)

( * ) Notice: Subject to any disclaimer, the term of this patent is extended or adjusted under 35 U.S.C. 154(b) by 74 days.

(21) Appl. No.: 10/282,793

(22) Filed: Oct. 28, 2002

(65) Prior Publication Data

US 2004/0079357 A1 Apr. 29, 2004

(51) Int. Cl.[7] ..... F24B 1/182

(52) U.S. Cl. ..... 126/506; 126/519; 126/548; 126/551; 126/190

(58) Field of Search ..... 126/506, 519, 126/544, 547, 548, 550, 551, 554, 190, 201, 85 R, 92 B; D23/348

(56) References Cited

U.S. PATENT DOCUMENTS

| | | | | | |
|---|---|---|---|---|---|
| 1,190,665 | A | | 7/1916 | Miller | |
| D90,015 | S | | 5/1933 | Bridge | |
| 2,474,169 | A | * | 6/1949 | Shelton | 126/85 R |
| 2,725,872 | A | | 12/1955 | Richards | |
| 2,836,236 | A | * | 5/1958 | Weir | 160/19 |
| 3,220,400 | A | | 11/1965 | Yager | |
| 3,359,968 | A | * | 12/1967 | Thulman | 126/550 |
| 3,421,495 | A | * | 1/1969 | Winegardner | 126/555 |
| 3,499,432 | A | | 3/1970 | Hannebaum | |
| 3,777,735 | A | | 12/1973 | Miller | |
| 4,112,913 | A | * | 9/1978 | Shimek et al. | 126/519 |
| 4,216,760 | A | | 8/1980 | Wiggins | |
| D318,327 | S | | 7/1991 | Sorenson | |
| 5,598,834 | A | | 2/1997 | Grady | |
| 5,836,298 | A | | 11/1998 | Grady | |
| 5,960,788 | A | | 10/1999 | Bach et al. | |
| D420,115 | S | | 2/2000 | Bach et al. | |
| 6,220,240 | B1 | | 4/2001 | Grady et al. | |
| 6,267,113 | B1 | * | 7/2001 | Maust et al. | 126/512 |

* cited by examiner

*Primary Examiner*—Jiping Lu

(57) ABSTRACT

An outdoor fireplace having a supporting base and a vertical pedestal projecting upwardly from the base. A firebox in the shape of a hollow bowl open at its top is supported by the pedestal. A vertical hollow cylindrical wall is carried at its bottom end by the periphery of the hollow bowl and is made up of a series of fixed rigid, open screen, arcuate panels and one rigid open screen arcuate panel slidably carried at its upper end by a horizontal track which extends between two of the fixed panels at each of its ends. The fixed panels are affixed at their upper ends to the lower peripheral edge of the larger end of an inverted dish-like member. The inverted dish-like member has a central opening therein to provide a vent. Projecting above and at opposed sides of the central opening is a pair of vertical support members. A cover member is carried by the vertical support members and overhangs the central opening. Means forming part of the periphery of the hollow bowl are provided for engaging the slidable rigid open screen arcuate panel at its lower end.

8 Claims, 5 Drawing Sheets

FIREPIT

BACKGROUND OF INVENTION

Various small outdoor fireplaces have been proposed or are in actual use. For example, Sorensen U.S. Design Pat. No. 318,327 shows the ornamental features of a fireplace which is closed at the top and apparently has grating which can be slidably opened at its side. However, there is no indication how the grating is supported or carried, and whether the slidable grating is a rigid or a flexible, drape-like material.

Yager U.S. Pat. No. 3,220,400 describes a stove construction having a pair of separable flexible fireplace drawscreens.

Grady U.S. Pat. No. 5,598,834 pertains to a portable outdoor fireplace closed at the top having multiple rigid vertical side screen panels. One of the panels is removable and insertable.

Grady U.S. Pat. No. 5,836,298 relates to a portable outdoor fireplace closed at the top having one or two vertically supported hinged side screen panels.

Hannebaum U.S. Pat. No. 3,499,432 describes a heating unit having a chimney at the top with a plurality of enclosing glass side panels surrounding the firebox.

Miller U.S. Pat. No. 3,777,735 discloses a fireplace having an exhaust pipe at the top and circular side curtains hung from rails.

Wiggins U.S. Pat. No. 4,316,760 describes a fireplace open at the top with frustoconical sheet metal sides having a opening therein for a firescreen which is movable in a channel.

Bach et al U.S. Pat. No. 5,960,788 and Bach et al U.S. Design Pat. No. 420,115 relate to a collapsible outdoor fireplace having a hinged door.

SUMMARY OF INVENTION

Briefly, the present invention comprises an outdoor fireplace having a supporting base, a vertical pedestal projecting upwardly from said base, a firebox in the shape of a hollow bowl open at its top and supported by said pedestal, a vertical hollow cylindrical wall carried at its bottom end by the periphery of said hollow bowl and comprising a series of contiguous fixed rigid, open screen, arcuate panels and one rigid open screen arcuate panel slidably received between two of said fixed panels and carried at its upper end by a horizontal track which spans two of said fixed panels, said fixed panels being affixed at their upper ends to the lower peripheral edge of the larger end of an inverted dish-like member, said inverted dish-like member having a central opening therein providing a vent, and means forming part of the periphery of said hollow bowl for engaging said slidable rigid open screen arcuate panel at its lower end.

The slidable open screen panel is provided at its upper extremity with horizontally spaced apart hooks which slidably ride on the horizontal track. This track and associated hooks make opening and closing of the fireplace simple, safe and smooth. There is no risk of any part of the slidable panel coming into contact with the contents of the fireplace. The lower means for engaging the slidable open screen panel may be either an upstanding member integrally formed with the periphery of the hollow bowl in which case the slidable open screen panel has horizontally spaced apart hooks to slidably engage the upstanding member. Alternatively, the lower means for engaging the slidable open screen panel may be a groove integrally formed in the periphery of the hollow bowl in which case the lower edge of the slidable open screen panel rides in the groove.

The use of the upstanding member or the groove to engage the lower extremity of the slidable open screen panel provides distinct advantages over the use of a lower bridging track member which is supported only at its ends and can distort due to its proximity to the heat generated in the hollow bowl, resulting in jamming or difficulty in sliding the open screen panel.

THE DRAWINGS

Turning to the drawings.

Figure 7A:
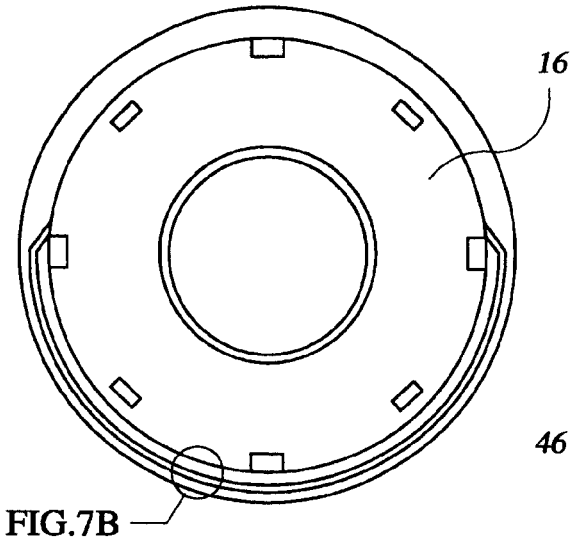
Figure 7B:
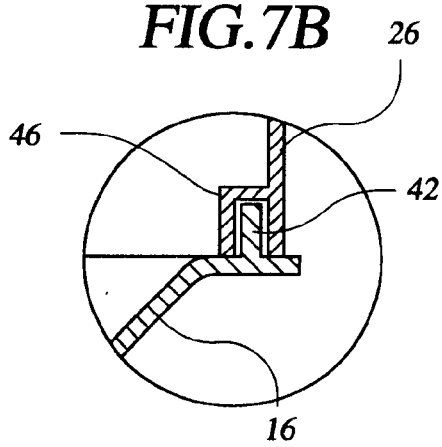

FIG. 7 showing a top view of the hollow bowl with integrally formed upstanding member (FIG. 7A) together with an enlarged partial section (FIG. 7B) showing a hook on the slidable open screen panel engaging the upstanding member.

Figure 8A:
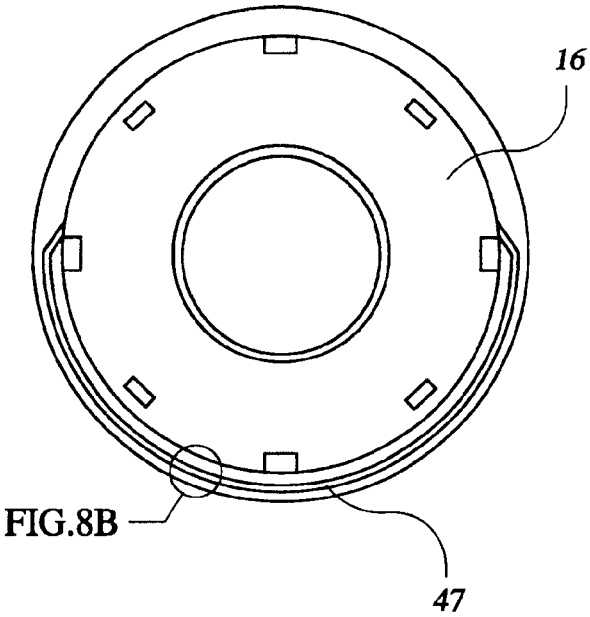
Figure 8B:
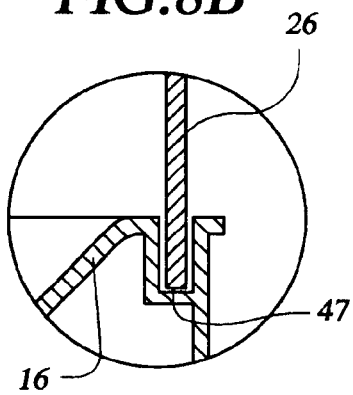

FIG. 8 shows the alternate embodiment to FIGS. 1 to 7 wherein the periphery of the hollow bowl has an integral ledge with a groove formed therein (FIG. 8A) which receives the lower edge of the slidable open screen panel (FIG. 8B).

DESCRIPTION OF PREFERRED EMBODIMENTS

Figure 1:
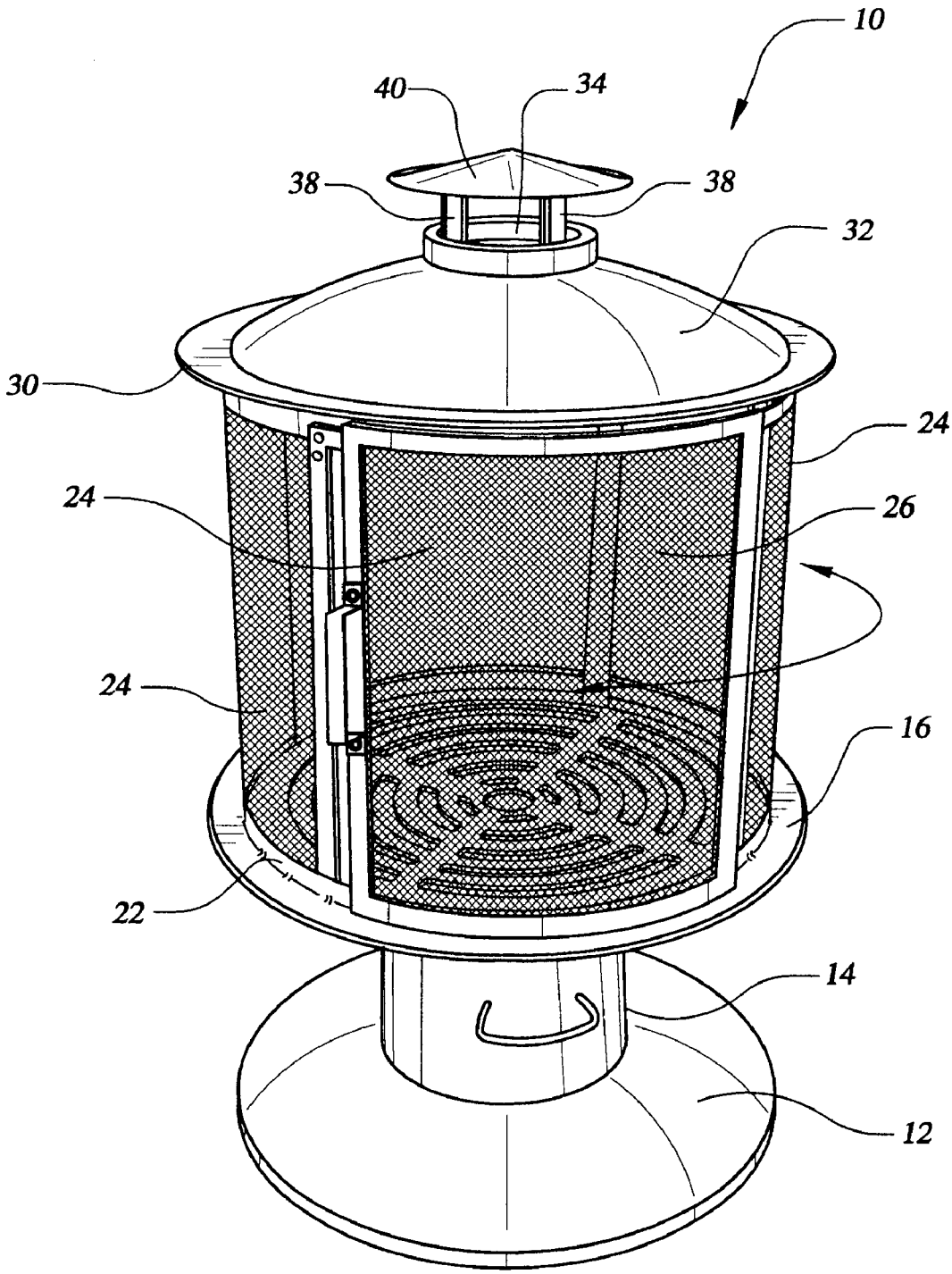
FIG. 1 is a perspective view of the preferred embodiment of the fireplace of this invention.
Figure 2:
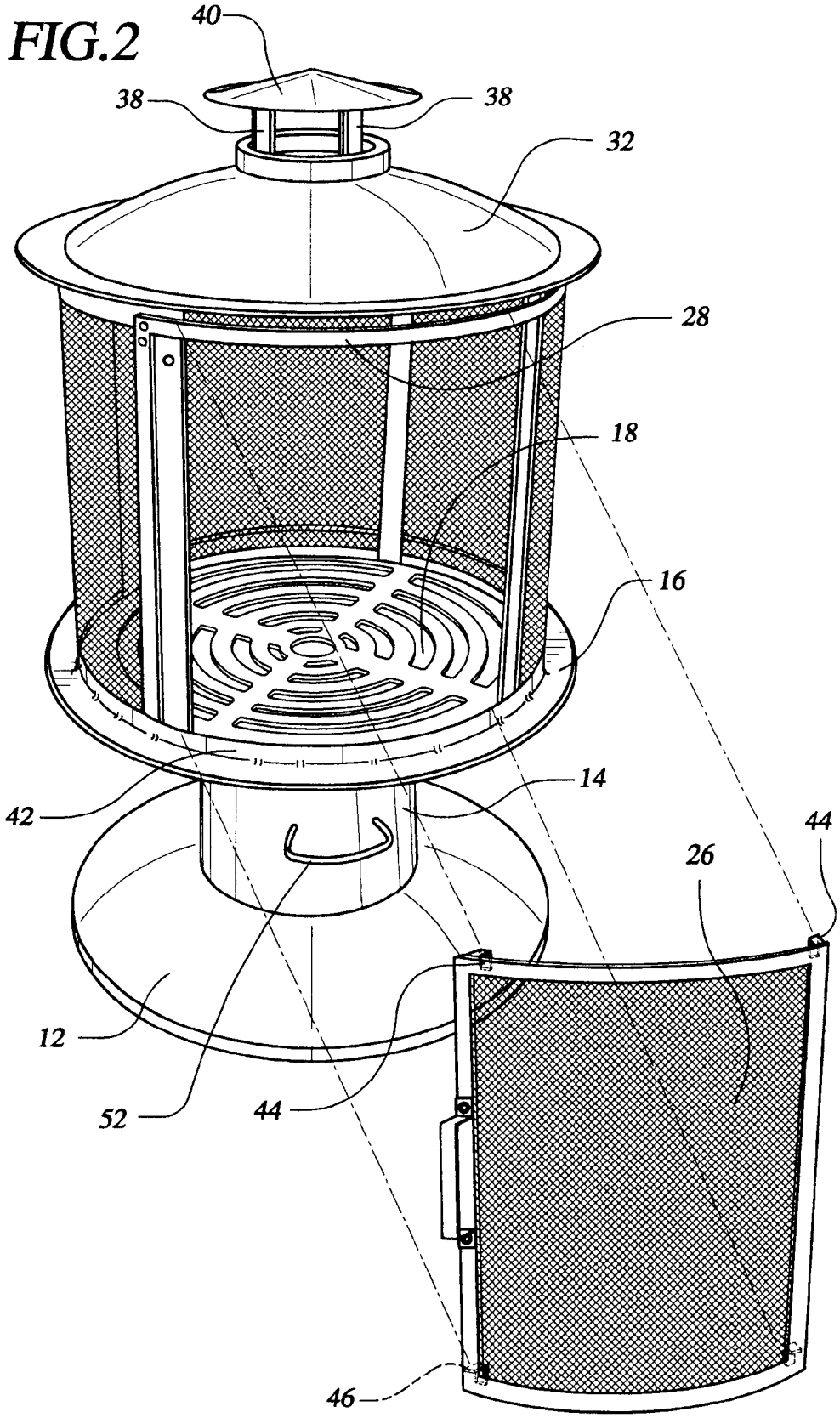
FIG. 2 shows the fireplace of FIG. 1 with the slidable open screen panel removed, exposing the interior of the fireplace and the upper and lower horizontal tracks on which the slidable panel rides.
Figure 3:
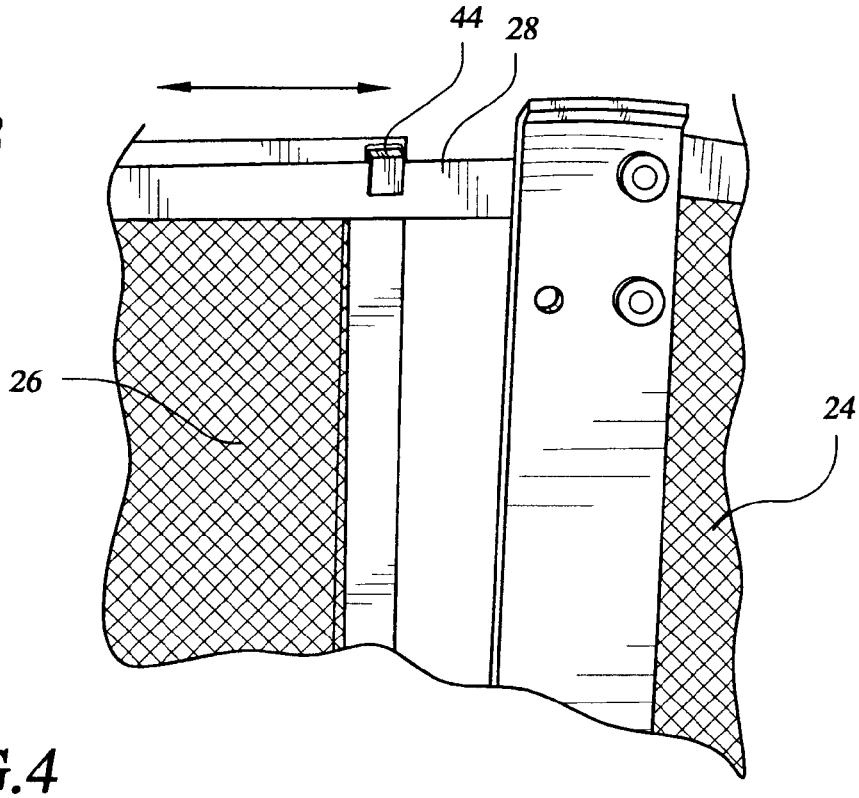
FIG. 3 is a partial enlarged rear view of the upper horizontal track spanning two fixed panels and showing part of the sliding panel with one of the hooks riding in place on the horizontal track.
Figure 4:
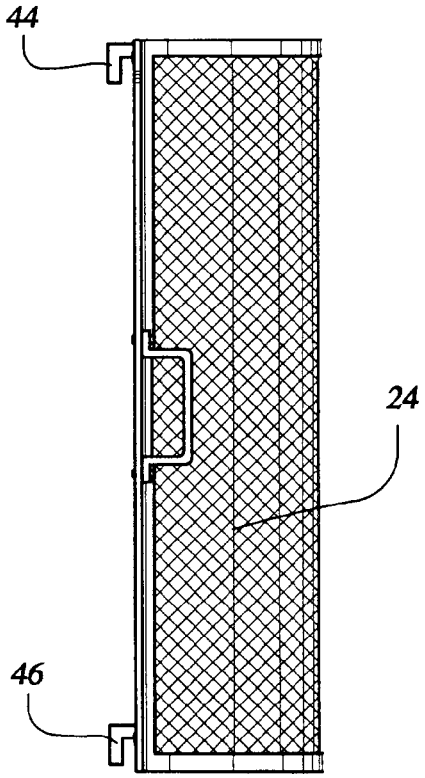
FIG. 4 is a side plan view of the arcuate slidable open screen panel.
Figure 5:
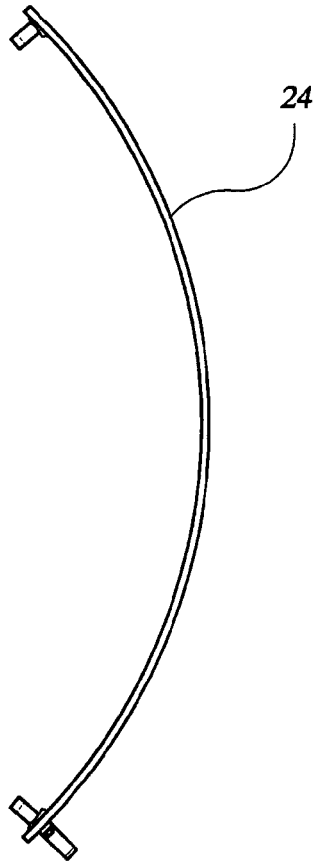
FIG. 5 is a top plan view of the arcuate slidable open screen panel.
Figure 6:
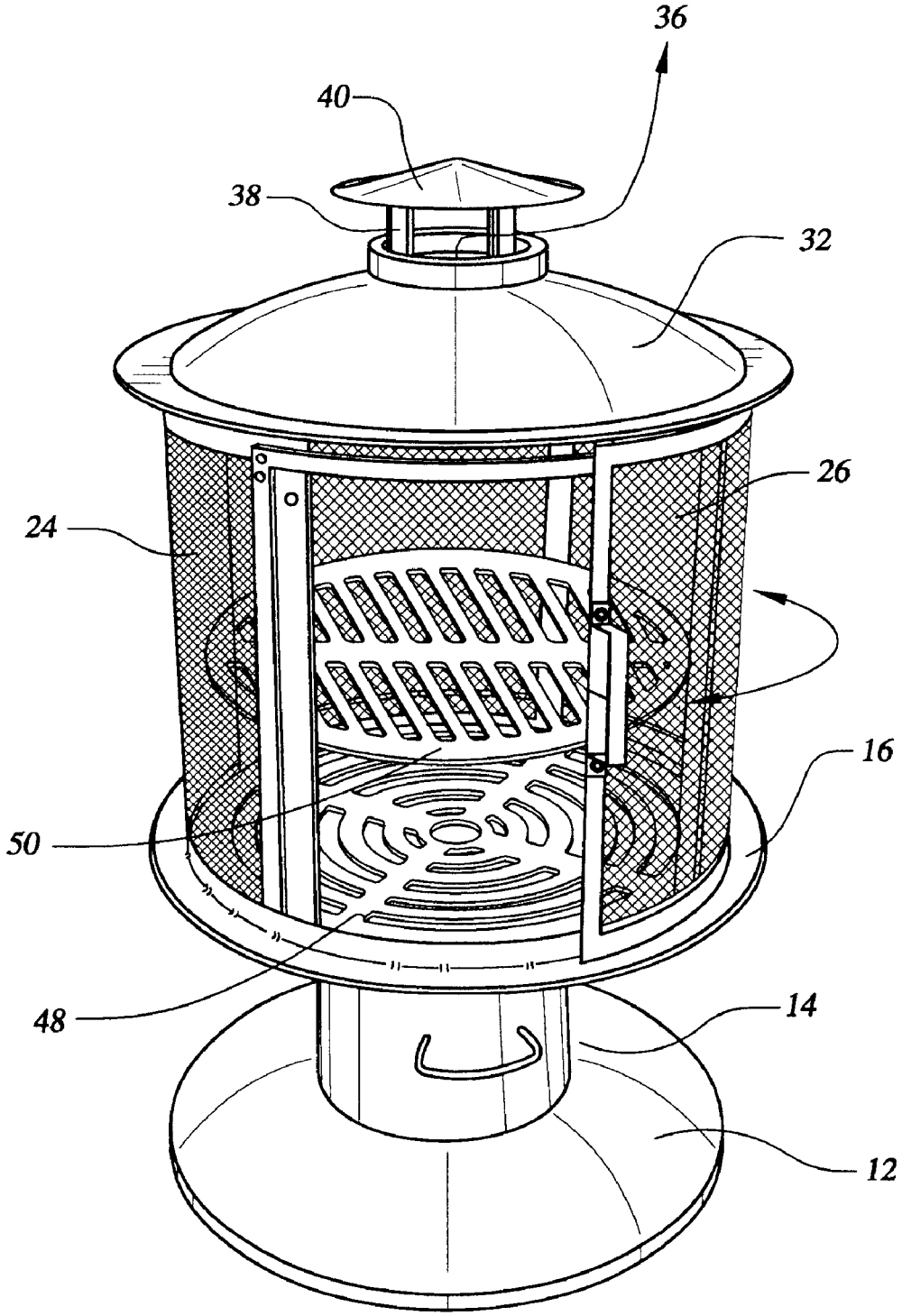
FIG. 6 shows the fireplace of FIGS. 1 to 5 further provided with the optional centrally disposed swingout cooking grill or grate and showing the slidable panel partially slid open.

Turning to the drawings in more detail, FIG. 1 shows an outdoor fireplace 10 having a supporting base 12, a vertical pedestal 14 projecting upwardly from the base 12, a firebox in the shape of a hollow bowl 16 open at its top 18 and supported by the pedestal 14, a vertical hollow cylindrical wall 20 carried at the bottom end 22 by the periphery of said hollow bowl 16 and comprising a series of fixed rigid, open screen, arcuate panels 24 and one rigid open screen arcuate panel 26 slidably carried at its upper end by a horizontal track 28 which extends between two of the fixed panels at each of its ends.

The fixed panel 24 are affixed at their upper ends to the lower peripheral edge 30 of the larger end of an inverted dish-like member 32, the inverted dish-like member 32 having a central opening 34 therein providing a vent 36, projecting above and at opposed sides of the central opening, a pair of vertical support members 38 and a cover member 40 carried by the vertical support members 38 and overhanging the central opening 34.

The slidable panel 26 is provided at its upper edge with a pair of spaced-apart hooks 44 which engage track 28. In the embodiment of FIG. 7, another pair of spaced-apart hooks 46 engage the integral upstanding member 42 formed in the periphery of hollow bowl 16. In this way, the slidable panel 26 is securely held at both of its upper and lower extremities and still can easily be slid open and shut, as indicated by the curved arrows shown in FIGS. 1 and 6, to access the interior of the fireplace and to close the fireplace to prevent undesired escape of sparks and ash.

Alternatively, as shown in FIG. 8, the periphery of hollow bowl 16 can have an integrally formed ledge in which groove 47 is formed. The lower edge of slidable panel 26 rides in groove 47.

The central dish like member 32 is closed except for the opening 34 leading to the vent 36.

The cover member 40 provides for dispersal and also permits outdoor use of the fireplace in rainy conditions.

Firegrate 48 is provided over the top of hollow bowl 16 forming the firebox.

In addition, a swingout horizontal grill 50 is useful for the preparation of food.

The pedestal 14 can be provided with a compartment or drawer 52 which collects the ashes falling from the firebox. The drawer 52 can be removed to dispose of ashes.

The bowl 16 can be formed of sheet metal or stainless steel and these materials are particularly adapted to the constructions shown in detail in FIG. 7. Bowl 16 can also be a cast metal which is preferred for the alternate embodiment of FIG. 8.

The holding of the lower edge of slidable panel 26 by hooks 46 and upstanding member 42 (FIG. 7), or by groove 47 (FIG. 8) provides the advantages discussed hereinabove.

What is claimed is:

1. An outdoor fireplace having a supporting base, a vertical pedestal projecting upwardly from said base, a firebox in the shape of a hollow bowl open at its top and supported by said pedestal, a vertical hollow cylindrical wall carried at its bottom end by the periphery of said hollow bowl and comprising a series of contiguous fixed rigid, open screen, arcuate panels and one rigid open screen arcuate panel slidably received between two of said fixed panels and carried at its upper end by a horizontal track which spans two of said fixed panels, said fixed panels being affixed at their upper ends to the lower peripheral edge of the larger end of an inverted dish-like member, said inverted dish-like member having a central opening therein providing a vent, and means forming part of the periphery of said hollow bowl for engaging said slidable rigid open screen arcuate panel at its lower end.

2. The outdoor fireplace of claim 1 wherein a firegrate is provided over said top of said hollow bowl.

3. The outdoor fireplace of claim 2 wherein a swingout grill is provided within said fireplace.

4. The outdoor fireplace of claim 1 wherein the pedestal has slidably received therein a drawer for catching ash and for use in removing ash.

5. The outdoor fireplace of claim 1 wherein said slidable open screen panel is provided at its upper end with horizontally spaced apart hook-like members which slidably ride on said track whereby said panel can be slid open to access the interior of said fireplace.

6. The outdoor fireplace of claim 1 wherein a pair of spaced apart vertical support members project above and at opposed sides of said central opening and a cover member is carried by said vertical support members and overhangs said central opening.

7. The outdoor fireplace of claim 1 wherein the periphery of said hollow bowl has an integrally formed upstanding member and said slidable rigid open screen arcuate panel has spaced apart hooks which engage said upstanding member.

8. The outdoor fireplace of claim 1 wherein the periphery of said hollow bowl has an integrally formed ledge containing a groove in which the lower edge of said rigid open screen arcuate panel is slidable received.

* * * * *